US012660895B2

(12) United States Patent
Aivaz

(10) Patent No.: US 12,660,895 B2
(45) Date of Patent: Jun. 23, 2026

(54) EXPANDABLE WATCH BAND HAVING STORAGE COMPARTMENT

(71) Applicant: Tracey Aivaz, Burbank, CA (US)

(72) Inventor: Tracey Aivaz, Burbank, CA (US)

( * ) Notice: Subject to any disclaimer, the term of this patent is extended or adjusted under 35 U.S.C. 154(b) by 99 days.

(21) Appl. No.: 18/492,666

(22) Filed: Oct. 23, 2023

(65) Prior Publication Data

US 2024/0156217 A1 May 16, 2024

Related U.S. Application Data

(60) Provisional application No. 63/418,332, filed on Oct. 21, 2022.

(51) Int. Cl.
*A44C 5/00* (2006.01)
*A44C 5/14* (2006.01)
*A44C 5/22* (2006.01)

(52) U.S. Cl.
CPC ..... *A44C 5/0069* (2013.01); *A44C 5/003* (2013.01); *A44C 5/147* (2013.01); *A44C 5/22* (2013.01)

(58) Field of Classification Search
CPC ..... A44C 5/0069; A44C 5/003; A44C 5/147; A44C 5/22
USPC ..... 224/175
See application file for complete search history.

(56) References Cited

U.S. PATENT DOCUMENTS 2,558,007 A * 6/1951 Smith ..... A44C 5/0069 267/74
2,695,740 A * 11/1954 Kolbe ..... A44C 5/0069 224/175
4,499,741 A 2/1985 Harris
4,757,926 A * 7/1988 Leo ..... A44C 5/00 224/178
4,905,879 A * 3/1990 Piccone ..... A44C 5/14 224/267
5,823,012 A 10/1998 Hacskaylo
6,108,876 A * 8/2000 Hubbert ..... A44C 5/003 24/3.2
D636,153 S 4/2011 Schrab
D712,094 S 8/2014 Branson
8,850,616 B1 10/2014 Hoover et al.
10,555,563 B2 2/2020 Treyger
D926,442 S 8/2021 Lopes
2009/0064393 A1 3/2009 Lambertz
(Continued)

FOREIGN PATENT DOCUMENTS

DE 202010015483 U 3/2012

OTHER PUBLICATIONS

Bandi Wear, htts://bandiwear.com/collections/pocketed-headbands.

*Primary Examiner* — Peter N Helvey
(74) *Attorney, Agent, or Firm* — Gary L Eastman, Esq.; Eastman IP

(57) ABSTRACT

An expandable watch band having storage compartment suitable for comfortably fitting a variety of wrist sizes. The watch band includes a top and bottom portion of an adjustable elastic band that is circumferentially surrounded by an outer tube of bunched fabric along its length. The watch band also includes two fastening clips at the end of the length of the top portion and bottom portion, respectively, suitable for connecting to a watch face. The watch band has an opening aperture at least partially along the length of the fabric tubing that, when opened, forms a cavity between the bunches of fabric tubing and elastic band suitable for storing personal items.

10 Claims, 7 Drawing Sheets

(56) References Cited

U.S. PATENT DOCUMENTS

| | | | | |
|---|---|---|---|---|
| 2010/0001016 | A1* | 1/2010 | Savage | B65D 83/0894 221/45 |
| 2010/0078452 | A1 | 4/2010 | Grise et al. | |
| 2021/0184411 | A1* | 6/2021 | Grau | H01R 35/02 |
| 2022/0256990 | A1* | 8/2022 | Brown | A45D 8/34 |

* cited by examiner

EXPANDABLE WATCH BAND HAVING STORAGE COMPARTMENT

RELATED APPLICATION

This application claims priority to U.S. Provisional Patent Application Ser. No. 63/418,332 for an "Expandable Watch Band Having Storage Compartment," filed Oct. 21, 2022, the entirety of which is incorporated herein by reference.

FIELD OF THE INVENTION

This present invention relates to a decorative and adjustable watch band, incorporating, in a combined structure, a storage compartment for personal items.

BACKGROUND OF THE INVENTION

As personal electronic devices become increasingly sophisticated, they also decrease in size and become more portable. For example, a smartphone, just smaller than a scientific calculator, may function as a device for timekeeping, telephoning, messaging, payment keeping, in addition to computing numbers—consequently obviating the need to carry additional devices that accomplish these tasks. A smartwatch achieves much of the same at a fraction of the size and weight of a smartphone.

This convenience allows one to become more mobile by carrying less weight, as well as more time-efficient by saving time packing less belongings. However, the convenience of a smartwatch does not allow one to be completely hands-free. The user will still likely need to carry a variety of additional personal items including house keys, car keys, IDs, hair ties, lip balm, or breath mints, just to name a few.

Comfort and style are also of the utmost importance with smartwatches as they are always found about the wrist of the user, serving as an extension of the person. However, smartwatches ordinarily come with a band that is rigid in material and structure. Replacing a watch band with a typical elastic band may alleviate issues concerning comfort and style, though, elastic bands create a number of other issues. To start, elastic bands are not long-lasting. More specifically, elastic is prone to overstretching and wears out over time. This renders them less useful after a short term and further creates an issue with waste. There is no other solution to overcome this problem other than purchasing a new a product. The user cannot replace just the elastic portion of the band from the fabric it is combined with, a band chosen likely for its specific design and style.

Moreover, without the elasticity of an expandable band, a classic watchband is stiff and is only adjustable up to a small range of sizes. This poses an issue for individuals having a change in body mass index, including a growing child, a pregnant woman, or an individual having undergone dramatic weight gain or loss. Also, when the band becomes overstretched, the consumer must purchase a new one, creating an additional problem of waste.

In view of the above, it would be advantageous to provide an expandable watch band having a storage compartment that can provide discreet storage space and suit a variety of wrist sizes. It would be further advantageous to provide an expandable watch band that is fashionable and personal to the consumer's tastes in patterns and fabric.

SUMMARY OF THE INVENTION

Disclosed is a watch band having a storage compartment including a length of elastic covered by a tube of fabric, together, forming a watch band with a top end and bottom end. The top and bottom ends of the watch band are capable of being secured to a clip corresponding to a watch face including but not limited to smartwatch faces sold under the trademarks Apple, Fitbit, and Samsung. The inside elastic is adjustable in length. For instance, the expandable watch band may be accompanied with one or more slide hooks to adjust the length of the watch band, making it suitable for a variety of wrist sizes. The outside tube of fabric bunches along the length of the inner elastic and includes an opening aperture, such as a zipper, to access the slide hooks and access a cavity formed between the space of the elastic band and the inside of the fabric tubing. The cavity is suitable for storing personal items.

The present invention seeks to further the pursuit towards free-range mobility while fulfilling the consumer's desire for comfort and personal taste. The present invention combines a stylish and comfortable watch band, with a discreet storage compartment along its entire length, eliminating the need to lug a secondary carry-on for essential items. The watch band's integral storage compartment is equal in size along the length of the expandable band such that the storage compartment is discreet and not bulky. When worn, the bunched fabric tubing allows the band to retain its style and shape similar to when the storage compartment is not filled.

The present invention also overcomes the problem of overstretching common with consistent use of elastic over time. To alleviate this issue, the present invention is equipped with slide hooks to adjust the band size, making the invention longer-lasting and suitable for wrists of all sizes. Additionally, having this one-size fits all structure decreases manufacturing costs.

A brief description of the drawing of the present invention shall highlight features and advantages of the invention.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
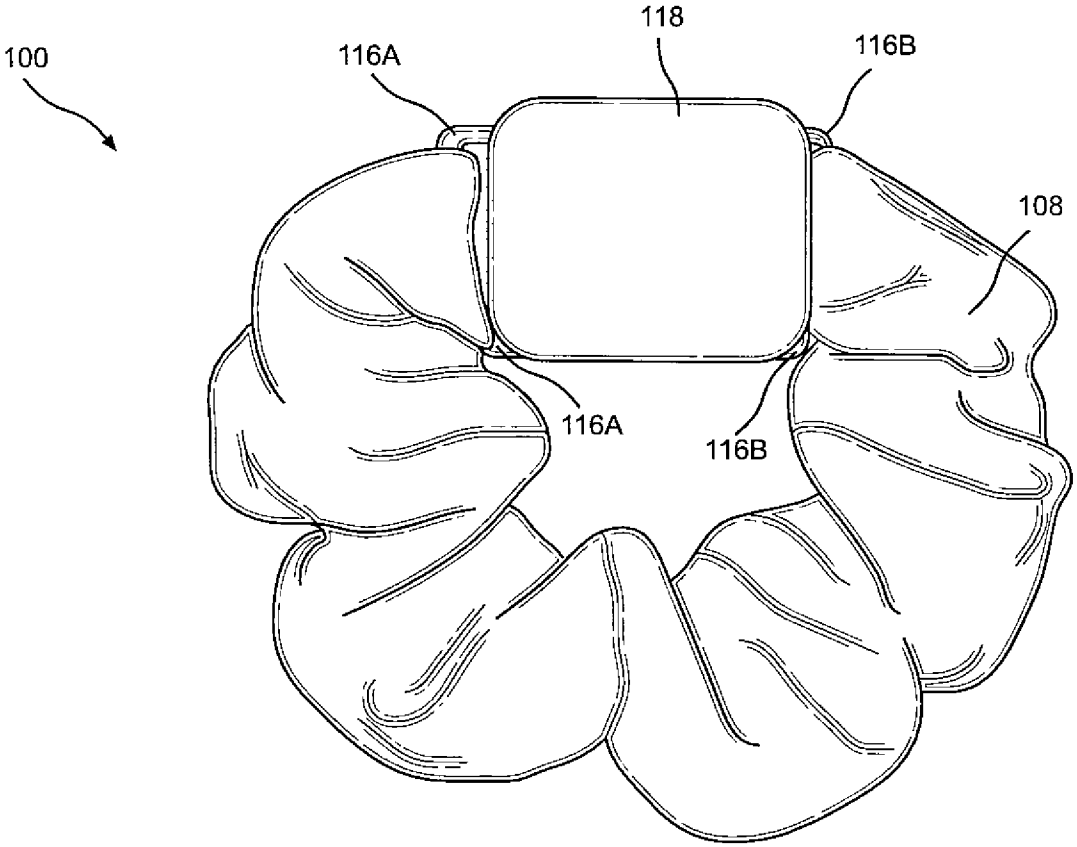
FIG. 1 is a top perspective view of a preferred embodiment of an expandable watch band in accordance with the present invention.
Figure 3:
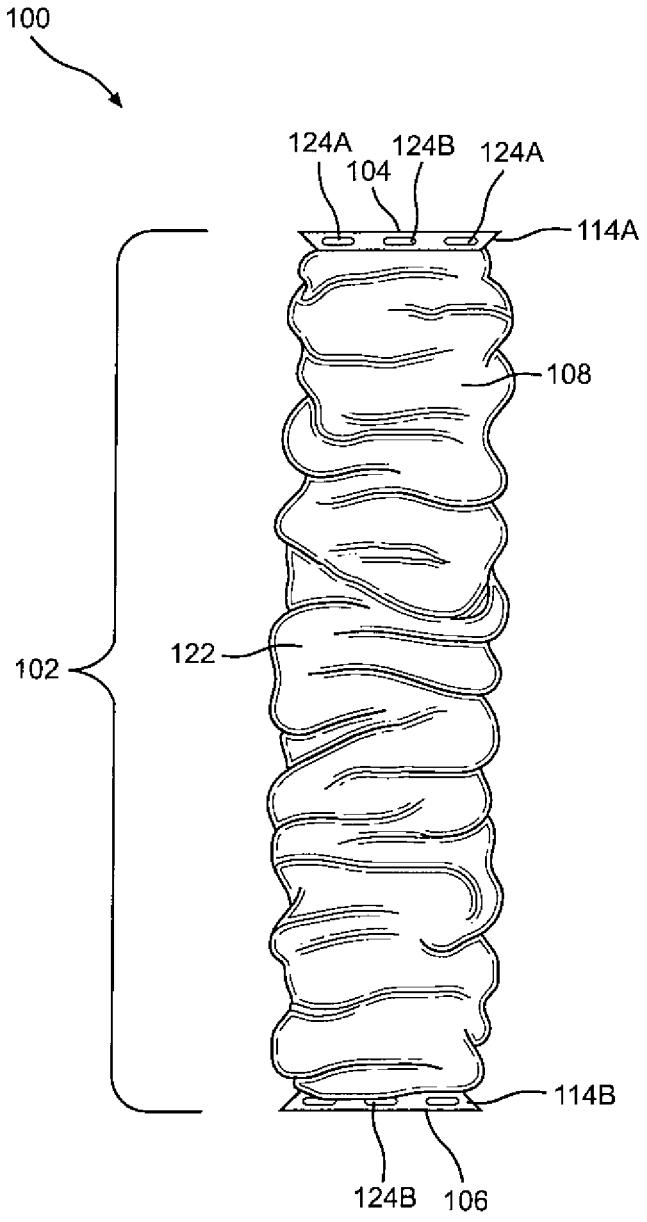
FIG. 3 is a side view of FIG. 1 unclipped from the watch face.

Referring initially to FIG. 1, a top perspective view of a preferred embodiment of an expandable watch band having a storage compartment in accordance with the present invention is shown in its closed configuration and generally designated 100. The expandable watch band having a storage compartment 100, or watch band 100, has a substantially rectangular body 102, with a top end 104 and bottom end 106 (as shown in FIG. 3). The watch band 100 further includes an exterior fabric tubing 108 that, in a preferred embodiment, terminates at a fastening clip 114A at the top end 104 as well as a second fastening clip 114B at the bottom end 106 of the body 102 (as shown in FIG. 3). The fastening clips 114A-B engage two receiving ends 116A-B belonging to a watch face 118, wherein one receiving end 116A receives the fastening clip 114A from the top end 104 and the other receiving end 116B receives the fastening clip 114B from the bottom end 106. The receiving ends 116A-B are on opposite and parallel sides of the watch face 118 such that the watch band 100 forms a ring in the shape of a wristband when the fastening clips 114A-B engage the receiving ends 116A-B of the watch face 118. In some embodiments, the fabric tubing 108 has a different material, color, or aesthetic appearance, such as a fabric that is more durable, waterproof, and/or feature colorful design elements.

Figure 2:
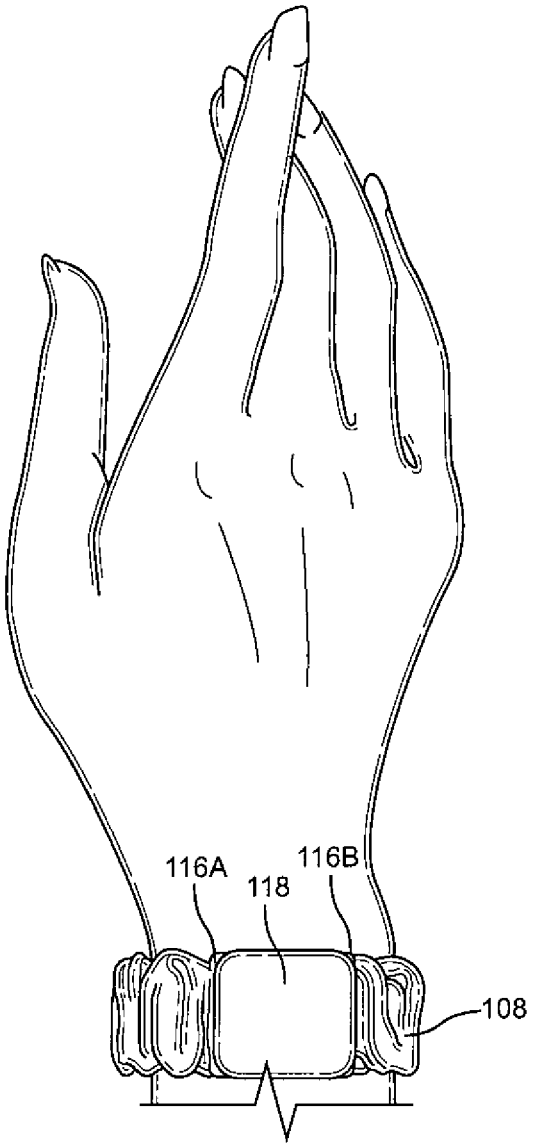
FIG. 2 illustrates the embodiment of FIG. 1 worn about the wrist of the user.

Referring now to FIG. 2, the watch band 100 is shown worn about the wrist of the user in a closed configuration. As illustrated in FIG. 2, the fabric tubing 108 expands and bunches about the wrist of the user. The fabric tubing 108 is made of a fabric that is both aesthetically pleasing and comfortable for wearing during long periods of time. Exemplary preferred embodiments include fabric tubing 108 made of satin, velvet, or cotton. The use of other fabrics known in the art, including mixed fabrics, is fully contemplated.

As illustrated in FIG. 3, the watch band 100 is shown in an open configuration with the watch face 118 (shown in FIGS. 1 and 2) removed. Also, an exterior surface 122, the panel of the watch band 100 that is exposed when worn, is illustrated. In a preferred embodiment of the watch band 100, the fastening clips 114A-B include concave 124A and convex snaps 124B to plug the fastening clips 114A-B into the receiving ends 116A-B of a smartwatch, but it would be possible to use alternative styles of watch band fasteners such as a traditional watch band needle. It is to be appreciated that fastening clips 114A-B can include a variety of means for securing the watch band 100 to the watch face 118, such as alternative patterns of corresponding concave snaps 124A and convex snaps 124B.

Figure 4:
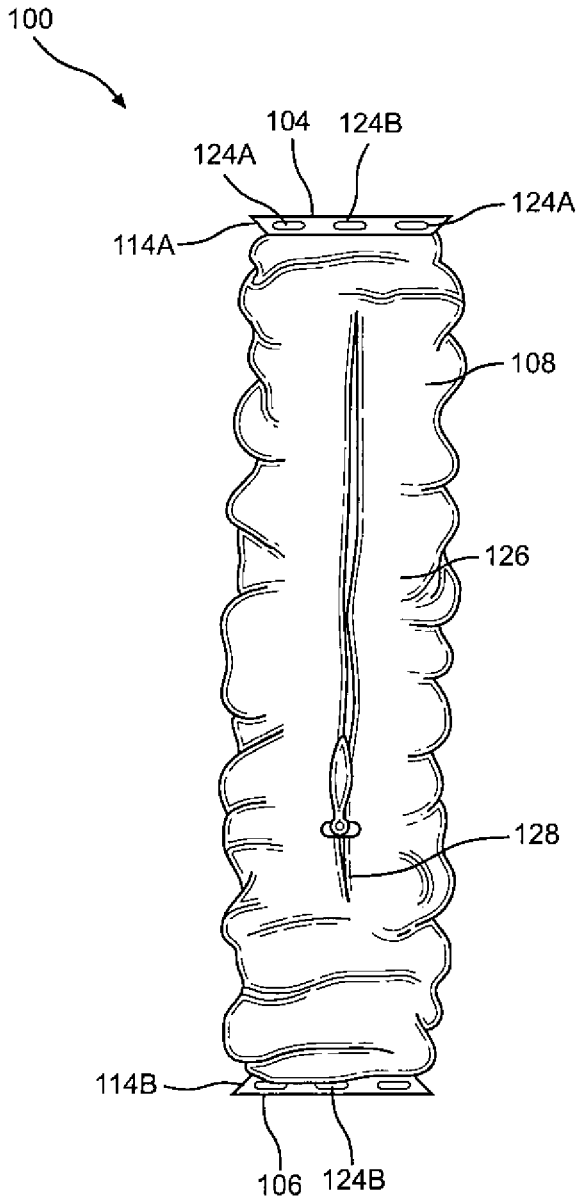
FIG. 4 is an inside panel view of the placement of the opening aperture.
Figure 5:
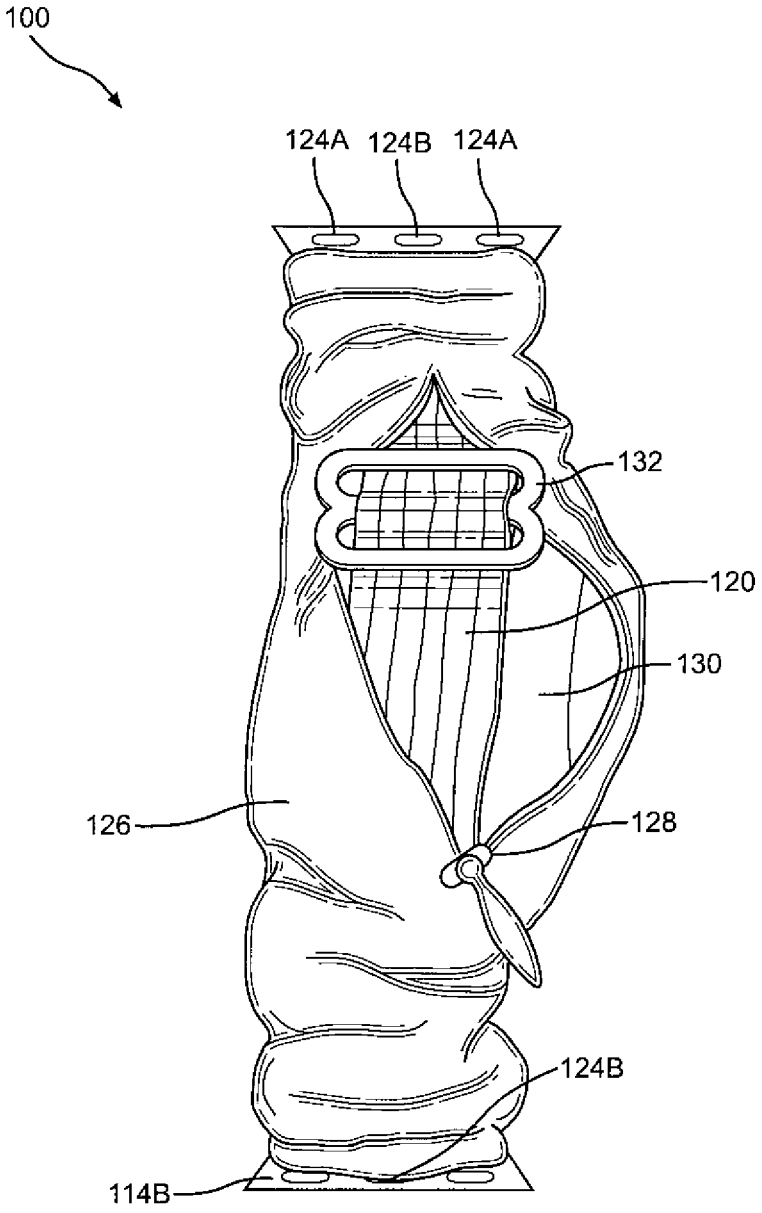
FIG. 5 is a perspective view of the placement of slide hooks on the adjustable elastic band.
Figure 6:
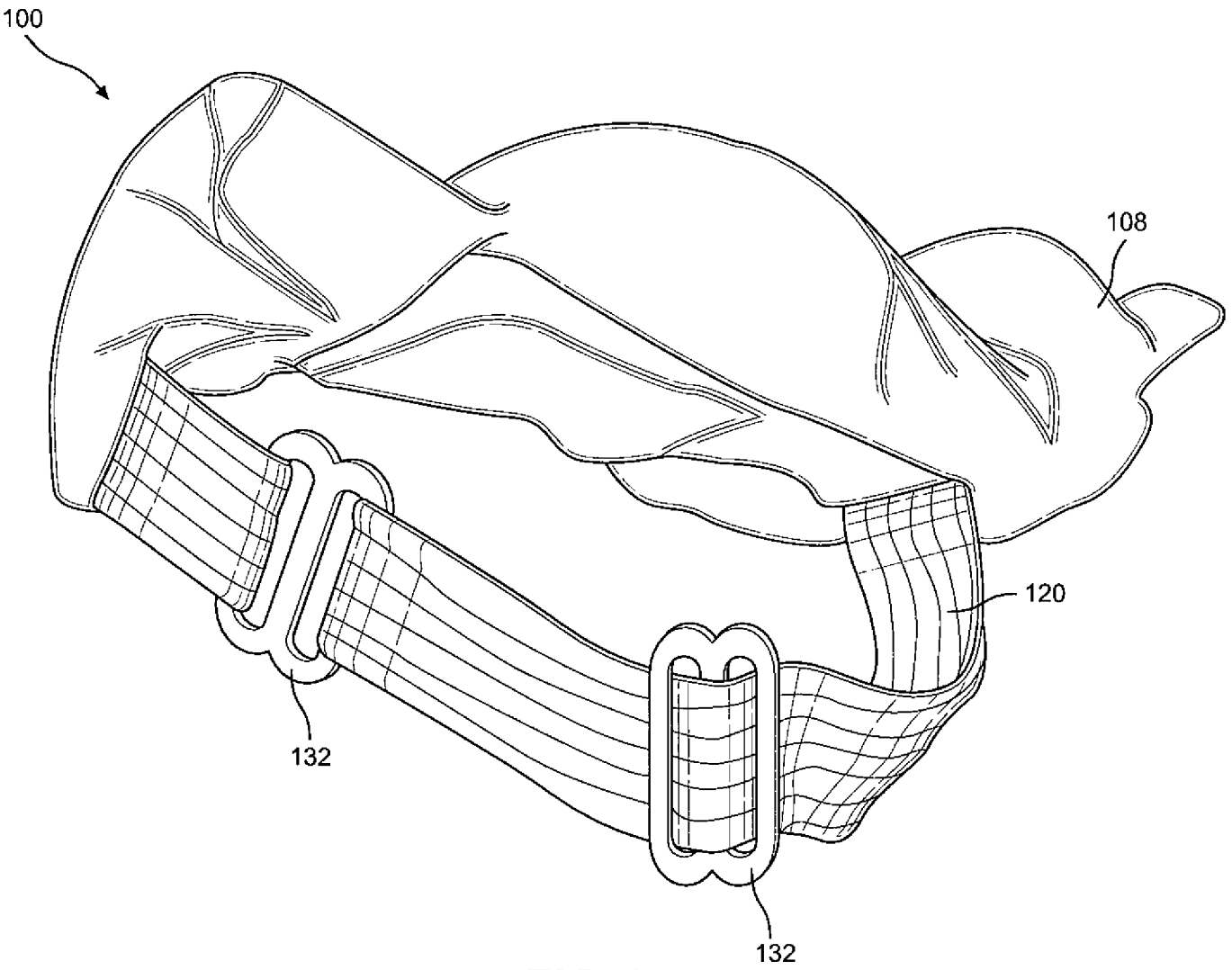
FIG. 6 is a side view of the expandable watch band in an open configuration revealing the inside elastic band with the adjustable slide hook and the storage compartment.

Referring now to FIG. 4, the watch band 100 is shown in an open configuration with the watch face 118 removed. Also, an interior surface 126, the panel of the watch band 100 that is concealed when worn, is illustrated. The interior surface 126 is the panel that lays against the wrist of the user when worn. The interior surface 126 of the fabric tubing 108 includes an opening aperture 128, that reveals an elastic band 120, as shown in FIGS. 5 and 6. As illustrated in FIG. 4, the opening aperture 128 is closed such that the fabric tubing 108 forms closely around the elastic band 120. It should be noted that the opening aperture 128 is demonstrated in the preferred embodiment as including a zipper, but may be used without departing from the spirit of the present invention. For example, it would be possible to use a number of vertical or horizontal hook-and-loop strips, snaps, buckles, ties, or other fasteners along the length of the interior surface 126. In some embodiments, the opening aperture 128 may extend partially, as shown in FIG. 4, or completely along the length of the interior surface 126. In alternative embodiments, the opening aperture 128 may be worn facing toward the wrist and thus concealed and not visible nor readily accessible from the outside. On the other hand, the opening aperture 128 may be worn facing away from the wrist and thus easily accessible. Thus, what is referred to as the interior surface 126 and exterior surface 122 are merely descriptive of a preferred embodiment, and if the watch band 100 is reversed, such references would likewise be reversed.

The fabric tubing 108 circumferentially surrounds the internal elastic band 120 and corresponds with the length of an elastic band 120. The fabric tubing 108, combined with the elastic band 120 are sealed by the fastening clips 114A-B at the top end 104 and bottom end 106 of the watch band 100. The fabric tubing 108 is larger than the elastic band 120 in length, height, and width. The fabric tubing 108 bunches around the elastic band 120 in order to terminate at the same ends of the fastening clips 114A-B, coordinating to form a single length for the watch band 100.

Referring now to FIG. 5, the watch band 100 is shown in an open configuration with the watch face 118 removed, revealing the inside elastic band 120 and slide hook 132. Also, the interior surface 126 of the watch band 100 demonstrates the opening aperture 128 unzipped, revealing a cavity 130 formed by the space between the bunches of fabric 108 and the elastic band 120. The cavity 130 functions as a discreet storage compartment for personal items including but not limited to house keys, car keys, IDs, hair ties, lip balm, or breath mints.

As illustrated in FIG. 5, and also in FIG. 6, the unzipped opening aperture 128 gives the user access to the adjusting slide hooks 132 to expand or reduce the length of the watch band 100. The unzipped opening aperture 128 also gives the user access to the cavity 130 that functions as a discreet storage compartment for personal items, formed by the space between the bunches of the fabric tubing 108 and elastic band 120. As illustrated in FIG. 5, the personal items may be stored along the entire length of the watch band in order to distribute the weight of the items evenly, or to the user's preference. The fabric tubing 108 and elastic band 120 combine and are sealed at the top end by fastening clips 114A-B, allowing for storage of personal items up to the top end 104 and bottom end 106 of the watch band 100.

Referring now to FIG. 6, a perspective view of the placement of slide hooks 132 on the adjustable elastic band 120 is shown. As illustrated in FIG. 6, aperture opening 128 is open and the interior surface 126 of the fabric tubing 108 is flipped inside-out, revealing the elastic band 120 concealed inside. Note, however, that the interior surface 126 could be configured to be away from the wearer's wrist. To achieve adjustable diameters of the elastic band 120 to suit a variety of wrist sizes, the elastic band 120 includes adjusting slide hooks 132 that may expand or reduce the length of elastic band 120. The fabric tubing 108 corresponds with the expanded or reduced length of the elastic band 120. It should be noted that slide hooks 132 are demonstrated in the preferred embodiment, but it would be possible to use a single or plurality of slide hooks 132. It will be apparent to those skilled in the art that various alternative adjusters and modifications can be made herein without departing from the scope and spirit of the invention, including hook and loop strips, snaps, buckles, ties, or other adjusters anywhere along the length of the elastic band 120.

Figure 7D:
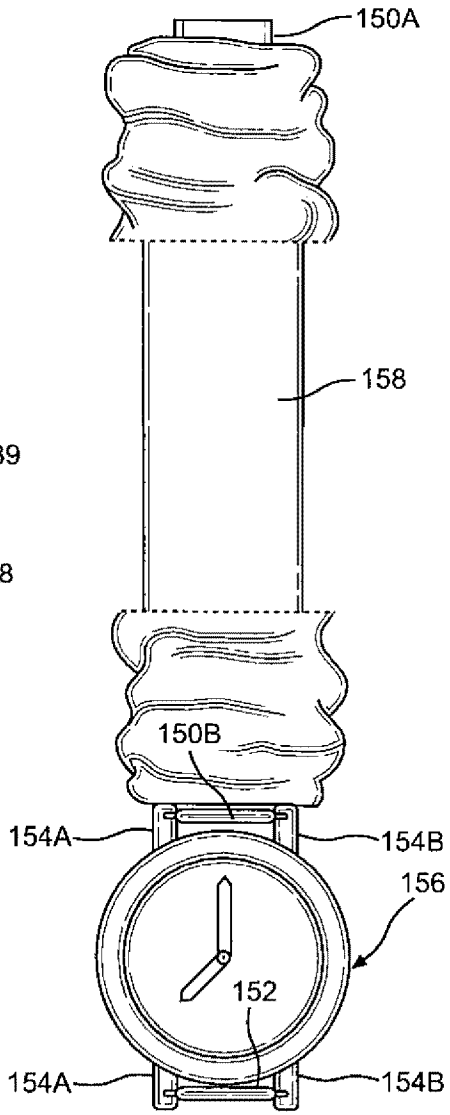
FIGS. 7A-D are side views of the expandable watch band with the fabric tubing removed for clarity, revealing an alternative expandable strap and alternative fasteners for an alternative watch body.
Figure 7C:
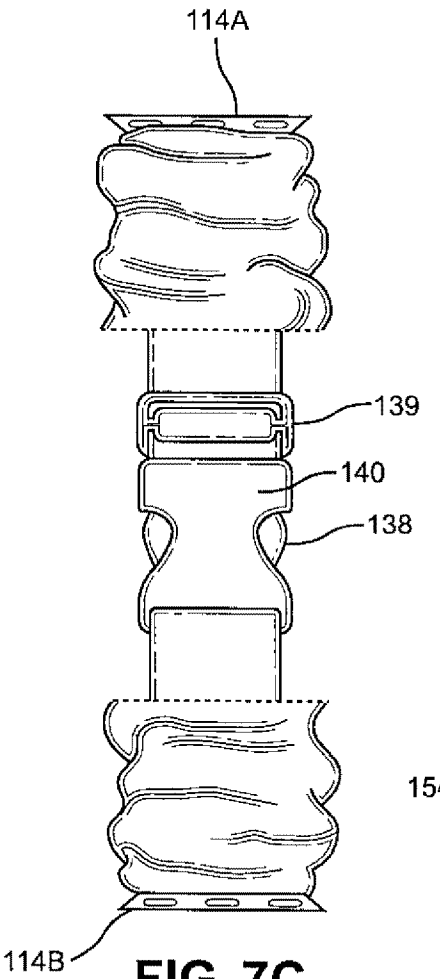
Figure 7B:
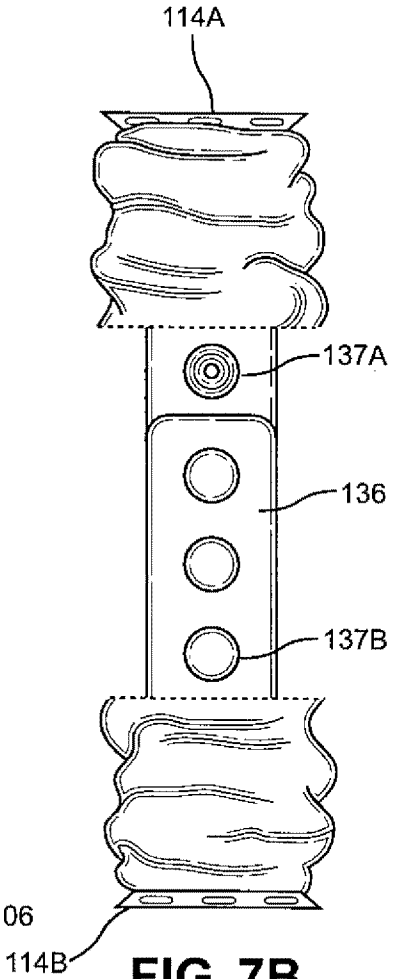
Figure 7A:
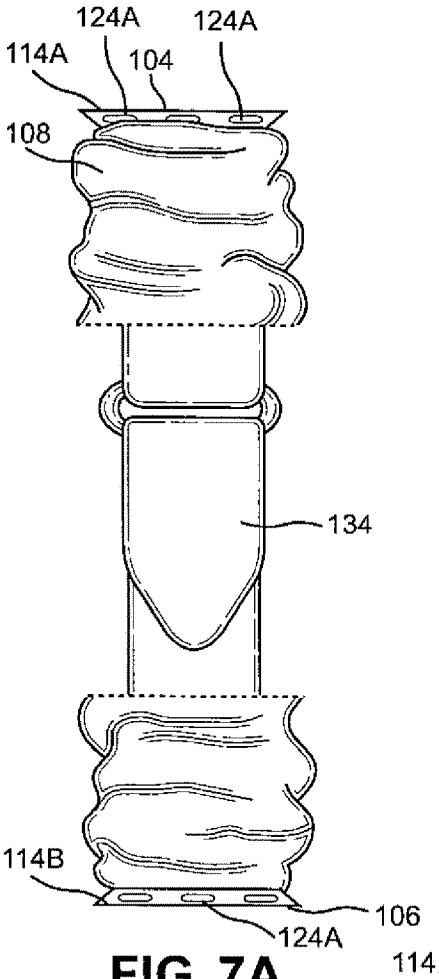

Referring finally to FIGS. 7A-D, the expandable watch band 100 is shown in an open configuration with the fabric tubing 108 removed for clarity, revealing alternative fastening fixtures. Such alternatives to the inner elastic band 120 include but are not limited to a hook and loop straps 134 as illustrated in FIG. 7A that allow the adjustment of the length of the inner strap 134. Alternatively, as shown in FIG. 7B, button snap straps 136 can be provided that allow the adjustability of the length of the strap 136 by selecting different one of an array of snap bases 137A to snap into one of an array of snap tops 137B. An alternative embodiment shown in FIG. 7C shows buckle clip 138 that can be adjusted lengthwise with buckle slider 139 and then clipped into base 140 to accommodate different lengths. As shown in FIG. 7D, the expandable watch band 100 is shown having an alternative fastening clip 150A and 150B designed to accept a standard needle fastener 152 that engages needle brackets 154A and 1548 extending from a traditional watch face 156.

It is to be appreciated by those skilled in the art that the expandable watch band may be equipped with any fastener suitable to engage a watch without departing from the present invention. Further, while there have been shown what are presently considered to be preferred embodiments of the present invention, it will be apparent to those skilled in the art that various changes and modifications can be made herein without departing from the scope and spirit of the invention.

What is claimed is:

1. An expandable watch band, comprising:

an inner band having a first end and a second end;

a bunched fabric body having a first end coterminal with the first end of the inner band and a second end coterminal with the second end of the inner band;

a closeable opening on a central portion of the body, the central portion of the body defining a compartment;

a first fastening clip on the first end of the body; and a second fastening clip on the second end of the body, wherein the first fastening clip and the second fastening clips are configured to removably attach to a watch face.

2. The expandable watch band of claim 1, further comprising an adjuster configured to adjust the length of the elastic band, wherein an adjustment of the length of the elastic band results in a corresponding adjustment in length of the bunched fabric body.

3. The expandable watch band of claim 2, wherein the adjuster is accessible through the closeable opening.

4. The expandable watch band of claim 2, wherein the adjuster comprises a slide hook.

5. The expandable watch band of claim 4, further comprising a second slide hook, the second slide hook linking a first portion of the elastic band to a second portion of the elastic band.

6. The expandable watch band of claim 5, wherein only the second portion of the elastic band is adjustable.

7. The expandable watch band of claim 1, further comprising a zipper along the closeable opening, the zipper configured to open and close the closeable opening.

8. The expandable watch band of claim 1, wherein the closeable opening is on an outer side of the central portion of the body.

9. The expandable watch band of claim 1, wherein the body comprises satin.

10. The expandable watch band of claim 1, wherein the inner band comprises elastic.

* * * * *